US010882539B2

(12) United States Patent
Benizeau et al.

(10) Patent No.: US 10,882,539 B2
(45) Date of Patent: Jan. 5, 2021

(54) RAILWAY VEHICLE HAVING PARTIALLY STANDARDIZED CARRIAGES

(71) Applicant: ALSTOM TRANSPORT TECHNOLOGIES, Saint-Ouen (FR)

(72) Inventors: Fabrice Benizeau, La Jarrie (FR); Paul Preiss, Reichshoffen (FR); Emmanuel Kondyra, La Rochelle (FR)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 266 days.

(21) Appl. No.: 15/939,001

(22) Filed: Mar. 28, 2018

(65) Prior Publication Data

US 2018/0281823 A1 Oct. 4, 2018

(30) Foreign Application Priority Data

Mar. 29, 2017 (FR) ..... 17 52623

(51) Int. Cl.

| | |
|---|---|
| ***B61D 3/10*** | (2006.01) |
| ***B61D 17/04*** | (2006.01) |
| ***B61D 1/06*** | (2006.01) |
| *B61D 1/00* | (2006.01) |
| *B61D 17/06* | (2006.01) |
| *B61F 3/12* | (2006.01) |

(52) U.S. Cl.

CPC ..... *B61D 3/10* (2013.01); *B61D 1/06* (2013.01); *B61D 17/045* (2013.01); *B61D 17/046* (2013.01); *B61D 1/00* (2013.01); *B61D 17/06* (2013.01); *B61F 3/125* (2013.01)

(58) Field of Classification Search

CPC ... B61D 1/00; B61D 3/00; B61D 3/10; B61D 3/12; B61D 3/14; B61D 3/18; B61D 15/06; B61D 17/20

See application file for complete search history.

(56) References Cited

U.S. PATENT DOCUMENTS 3,486,464 A * 12/1969 Dean ..... B61D 17/20 105/10
6,694,890 B2 * 2/2004 Kennedy ..... B60R 21/34 105/21

(Continued)

FOREIGN PATENT DOCUMENTS

DE 102007062517 A1 7/2009
EP 0995661 A1 4/2000

(Continued)

OTHER PUBLICATIONS

Preliminary Search Report dated Dec. 11, 2017 during the prosecution of French Patent Application No. 1752623.

*Primary Examiner* — Robert J McCarry, Jr.

(74) *Attorney, Agent, or Firm* — Troutman Pepper Hamilton Sanders LLP

(57) ABSTRACT

The railway vehicle comprises at least one end car, each arranged at a respective end of the railway vehicle, and, for each end car, a first car adjacent to this end car, and at least one second car, one of which is adjacent to the first car. Each second car comprises a second structural body. Each first car comprises a first structural body substantially identical to the second structural body of each second car, and a structural extension part attached on the first structural body and intended to be connected to the adjacent end car.

8 Claims, 1 Drawing Sheet

(56) References Cited

U.S. PATENT DOCUMENTS

| | | | | |
|---|---|---|---|---|
| 2003/0094116 | A1* | 5/2003 | Santti | B61D 1/06<br>105/396 |
| 2003/0172835 | A1* | 9/2003 | Ueta | B61D 3/10<br>105/3 |
| 2008/0190318 | A1 | 8/2008 | Palais et al. | |

FOREIGN PATENT DOCUMENTS

| | | | |
|---|---|---|---|
| EP | 1958844 | A1 | 8/2008 |
| EP | 1958847 | A1 | 8/2008 |
| JP | 2015047887 | A | 3/2015 |

* cited by examiner

RAILWAY VEHICLE HAVING PARTIALLY STANDARDIZED CARRIAGES

CROSS-REFERENCE TO RELATED APPLICATIONS

The present application claims priority from French Patent Application No. 1752623 filed Mar. 29, 2017. The entire contents of which are incorporated herein by reference.

FIELD OF THE INVENTION

The present invention relates to a railway vehicle, also called railway train, comprising partially standardized cars. More particularly, the invention relates to a railroad vehicle with at least one end car, each arranged at a respective end of the vehicle, for each end car, a first car adjacent to this end car, and at least one second car.

BACKGROUND

In the field of railway vehicles, it is known that a railway vehicle generally comprises two end cars, two first cars, and a plurality of second cars extending between the first cars.

Each second car comprises a structural body, such that the structural bodies of all of the second cars are substantially identical.

Conversely, each first car comprises a specific structural body, and a specific structural extension part attached on the specific structural body by welding. This specific form is necessary for the connection of the first car to the corresponding end car.

This first car is next equipped with different components (brackets, cables, pipes, miscellaneous equipment, etc.) in the finishing chain of the railway vehicle.

The production of such a railway vehicle is particularly time-consuming, inasmuch as it is necessary to produce two types of structural bodies to manufacture the first and second cars.

SUMMARY

The invention in particular aims to resolve this drawback by proposing a railway vehicle in which the first and second cars are partially standardized.

To that end, the invention in particular relates to a railway vehicle, comprising:

- at least one end car, each arranged at a respective end of the vehicle,
- for each end car, a first car adjacent to this end car,
- at least one second car, one of which is adjacent to the first car, characterized in that:
- each second car comprises a second structural body, and
- each first car comprises a first structural body substantially identical to the second structural body of each second car, and a structural extension part attached on the first structural body and intended to be connected to the adjacent end car.

The first and second structural bodies are substantially identical, and preferably identical, such that it is only necessary to produce one type of structural body to manufacture the first and second cars. Only the structural extension part is added to a second car to form a first car.

The structural extension part is assembled later on the structural body shared by the first and second cars to form a first car, therefore without disrupting the assembly chain of the structural bodies.

As a result, the production of a railway vehicle according to the invention is simpler, therefore faster than in the state of the art.

A railway vehicle according to the invention may further include one or more of the following features, considered alone or according to all technically possible combinations.

- The structural extension part of each first car is fastened by bolting to the first corresponding structural body.
- The structural extension part of at least one of the first cars is made from a different material from the corresponding first structural body.
- Each of the first cars and second cars shares a shared bogie with at least one other of the first cars and second cars.
- Each first car comprises its own bogie, on which the first structural body and the corresponding structural extension part rest.
- Each first car comprises its own bogie, on which the first structural body rests, the structural extension part being supported by the first structural body.

The invention also relates to a method for manufacturing a railway vehicle as previously defined, characterized in that it comprises producing a plurality of substantially identical structural bodies, then mounting each first car and each second car with one of the substantially identical structural bodies.

BRIEF DESCRIPTION OF THE DRAWINGS

Advantageously, the structural extension part of each first car is equipped with components prior to its assembly with the corresponding first structural body.

The invention will be better understood upon reading the following description, provided solely as an example and done in reference to the appended figures, in which.

DETAILED DESCRIPTION

Figure 1:
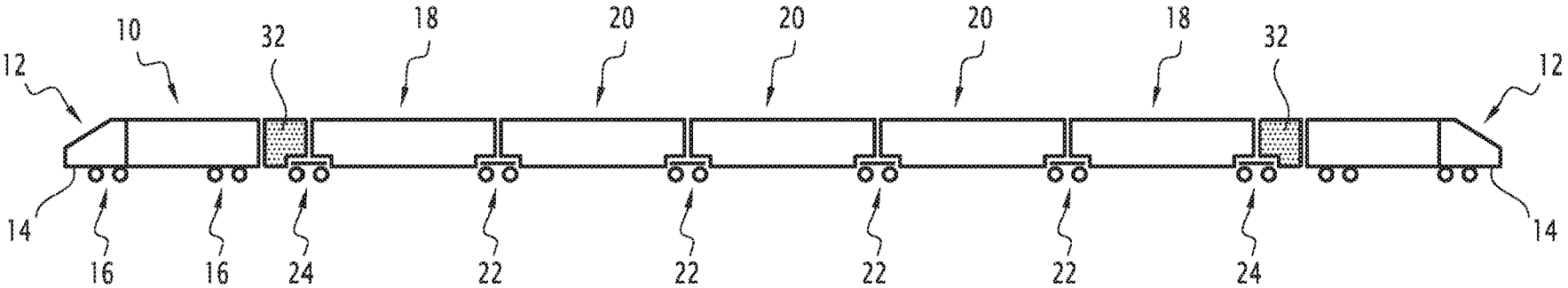
FIG. 1 is a schematic overview of a railway vehicle according to one example embodiment of the invention.

FIG. 1 shows a railway vehicle 10 according to one example embodiment of the invention. For example, the railway vehicle 10 is a high-speed train.

The railway vehicle 10 comprises at least one end car, preferably two end cars 12, each arranged at a respective end of the railway vehicle 10. Each end car 12 traditionally comprises a driving cabin 14, and each end car 12 is traditionally supported by two bogies 16, at least one of which is motorized.

The railway vehicle 10 further comprises, for each end car 12, a first car 18 adjacent to this end car 12. For example, the railway vehicle 10 comprises two first cars 18, each adjacent to a respective one of the two end cars 12.

The railway vehicle 10 for example comprises at least one second car 20, for example three second cars 20 aligned between the two first cars 18.

The railway vehicle 10 is of the articulated type, i.e., each of the first cars 18 and second cars 20 shares a shared bogie 22 with at least one other of the first cars 18 and second cars 20.

More particularly, each second car 20 is supported, at each of its ends, by a bogie 22 shared with a second car 20 or a first car 18 that is adjacent.

Furthermore, each first car 18 is supported, at one of its ends, by a bogie 22 shared with the adjacent second car 20, and at the other of its ends, by a bogie 24 that is specific to it. The end supported by the specific bogie 24 is that which is adjacent to the corresponding end car 12.

It should be noted that each specific bogie 24 is structurally identical to each shared bogie 22.

Figure 2:
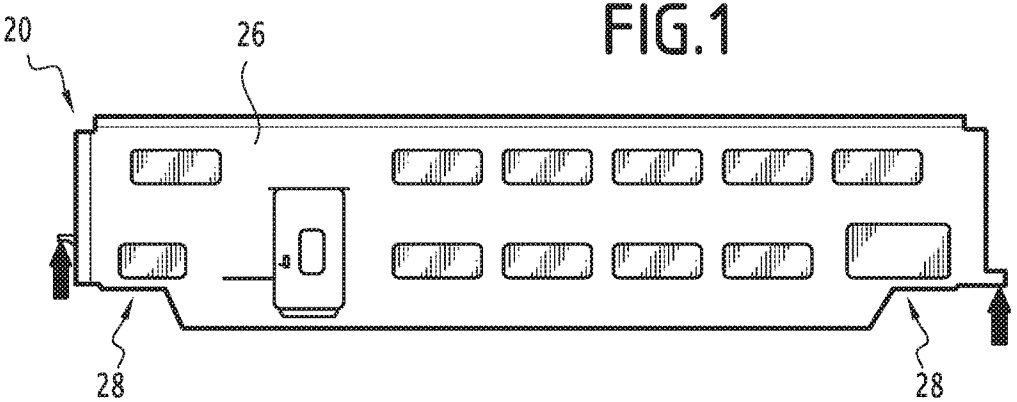
FIG. 2 is a schematic profile view of a structural body of a second car of the railway vehicle of FIG. 1.

As shown in FIG. 2, each second car 20 comprises a structural body 26 (hereinafter called second structural body 26). The second structural bodies 26 of all of the second cars 20 are all identical. The second structural bodies 26 are therefore standardized.

Each second structural body 26 comprises openings for windows, and at least one opening for a passage door for passengers to embark and disembark.

Each second structural body 26 in particular comprises, at each end, a half-spot 28 intended to accommodate part of the corresponding shared bogie 22. This half-spot 28 is intended to be arranged across from another half-spot 28 of an adjacent car, such that the corresponding shared bogie 22 is housed in the spot formed by these two half-spots 28.

In the illustrated example, the second car 20 has two floors, i.e., it comprises two passenger rooms arranged one above the other. However, alternatively, the second car 20 could comprise only one floor.

Figure 3:
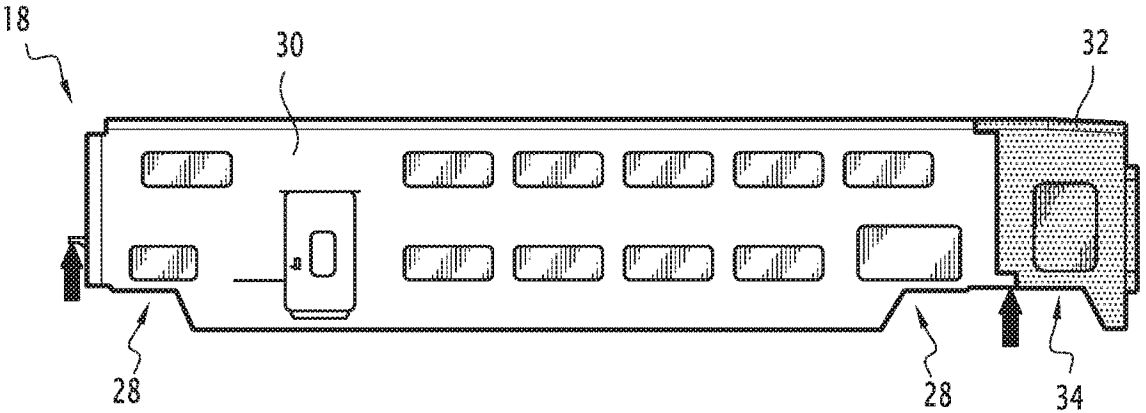
FIG. 3 is a schematic profile view of a structural body of a first car of the railway vehicle of FIG. 1.

As shown in FIG. 3, each first car 18 also comprises a structural body 30 (hereinafter called first structural body 30). This first structural body 30 is identical to the second structural body 26 of each second car 20. Thus, each first structural body 30 comprises openings for windows, and at least one opening for a passage door for passengers to embark and disembark.

Each first structural body 30 therefore also comprises, at each end, a half-spot 28 intended to accommodate part of the corresponding bogie 22, 24. Each first structural body 30 therefore rests partially on the bogies 22, 24 situated at these ends.

One of these half-spots 28 is intended to be arranged across from another half-spot 28 of a second adjacent car 20, such that the corresponding shared bogie 22 is housed in the spot formed by these two half-spots 28.

Conversely, the other half-spot 28 is arranged at the end of the first car 18 that is adjacent to the corresponding end car 12. Yet this end car 12 is supported by two bogies 16, such that there is no shared bogie between this first car 18 and the end car 12.

Thus, in order to connect the first car 18 to the end car 12, the first car 18 comprises a structural extension part 32 attached on the first structural body 30, and intended to be connected to the adjacent end car. The structural extension part 32 is configured to have a shape complementary to that of the end of the first structural body 30 where this structural extension part 32 is assembled. The structural extension part 32 has, in a longitudinal direction, a length shorter than the length of the structural body 30.

The structural extension part 32 has (at least partially) an extension half-spot 34, forming, with the corresponding half-spot 28, a spot for accommodating the specific bogie 24. The first structural body 30 and the corresponding structural extension part 32 rest on the specific bogie 24.

Alternatively, the structural extension part 32 is supported by the first structural body 30 and the first structural body 30 is supported by the bogie 24.

Advantageously, the structural extension part 32 of each first car 18 is fastened by bolting to the first corresponding structural body 30. Thus, the structural extension part 32 is advantageously already equipped with various components (such as brackets, cables, pipes, miscellaneous equipment, etc.) before being assembled with the first structural body 30, which makes the first car 18 easier to manufacture. Indeed, while in the state of the art, a welding operation could damage these components, a bolting operation does not have this risk.

Furthermore, it should be noted that the structural extension part 32 of at least one of the first cars 18 is for example made from a different material from the corresponding first structural body 30. In particular, when the structural extension part 32 is attached by bolting, there are no material constraints to be respected related to a welding operation. It is therefore possible to choose the most advantageous material, functionally or economically, for the structural extension part 32, independently of the material of the corresponding first structural body 30.

In the illustrated example, the first car 18 has two floors, i.e., it comprises two passenger rooms arranged one above the other. However, alternatively, the first car 18 could comprise only one floor.

A railway vehicle according to the invention is manufactured during a manufacturing method that will now be described.

The manufacturing method comprises producing a plurality of substantially identical structural bodies 26, 30. Identical means able to be built in the same production chain with an identical method, and in particular with globally the same dimensions.

Each structural body 26, 30 is next used to mount a corresponding car 18, 20, whether a first car 18 or a second car 20.

In the case of a first car 18, a structural extension part 32, intended to allow the connection with an end car 12, is attached on the first structural body 30, for example by bolting.

The structural extension part 32 of each first car is advantageously equipped with components prior to its assembly with the corresponding first structural body 30.

It should be noted that the structural extension part 32 on the first structural body 30 is preferably made outside the production chain for structural bodies and outside the main production chain, which will make it possible to limit disruptions to manufacturing and therefore to limit the manufacturing cycle time.

It will be noted that the invention is not limited to the embodiment previously described, but could have various alternatives without going beyond the scope of the claims.

The invention claimed is:

1. A railway vehicle extending between two ends, the railway vehicle comprising:

at least one end car, each arranged at a respective end of the railway vehicle, for each end car, a first car adjacent to this end car, each first car having a first structural frame, at least one second car, one of which is adjacent to the first car, each second car having a second structural frame wherein:

each second structural frame is constituted of a second structural body, and each first structural frame is constituted of a first structural body and a structural extension part, the first structural body being identical to the second structural body of each second car, and the structural extension part being attached on the first structural body and intended to be connected to the adjacent end car, wherein each first car comprises its own bogie.

2. The railway vehicle according to claim 1, wherein the structural extension part of each first car is fastened by bolting to the corresponding first structural body.

3. The railway vehicle according to claim 1, wherein the structural extension part of at least one of the first cars is made from a different material from the corresponding first structural body.

4. The railway vehicle according to claim 1, wherein each of the first cars and second cars shares a shared bogie with at least one other of the first cars and second cars.

5. The railway vehicle according to claim 1, wherein the first structural body and the corresponding structural extension part rest on the bogie.

6. The railway vehicle according to claim 1, wherein the first structural body rests on the bogie, the structural extension part being supported by the first structural body.

7. A manufacturing method for manufacturing a railway vehicle, wherein the method comprises:

producing a plurality of identical structural bodies, mounting at least one first car with one of the identical structural bodies and a structural extension part attached to this structural body, mounting at least one second car with another of the identical structural bodies, providing at least one end car, each arranged at a respective end of the railway vehicle, for each end car, connecting one of the at least one first car with this end car, the structural extension being connected to this end car, connecting one of the at least one second car to the first car.

8. The manufacturing method according to claim 7, wherein the structural extension part of each first car is equipped with components prior to its assembly with the corresponding structural body.

* * * * *